US010847125B1

(12) United States Patent
Kim et al.

(10) Patent No.: US 10,847,125 B1
(45) Date of Patent: Nov. 24, 2020

(54) DETACHABLE GUITAR

(71) Applicant: Session Man Co., Ltd., Seoul (KR)

(72) Inventors: Hyung Chan Kim, Seoul (KR); Won Sik Kim, Seoul (KR)

( * ) Notice: Subject to any disclaimer, the term of this patent is extended or adjusted under 35 U.S.C. 154(b) by 0 days.

(21) Appl. No.: 16/738,668

(22) Filed: Jan. 9, 2020

(51) Int. Cl.
*G10D 3/18* (2020.01)
*G10D 1/08* (2006.01)

(52) U.S. Cl.
CPC ..... *G10D 3/18* (2013.01); *G10D 1/08* (2013.01)

(58) Field of Classification Search
CPC ..... G10D 3/18; G10D 1/08
See application file for complete search history.

(56) References Cited

U.S. PATENT DOCUMENTS

2013/0139668 A1* 6/2013 Aires ..... G10G 5/005 84/267

* cited by examiner

*Primary Examiner* — Kimberly R Lockett
(74) *Attorney, Agent, or Firm* — Jake K. Lee

(57) ABSTRACT

Provided is a detachable guitar including: a body part including a head provided with a plurality of tuning pegs and a neck gradually extending in width toward an end portion thereof along a longitudinal direction of the head and having a plurality of strings, one end portion of which is wound around the tuning peg on an upper surface thereof; and a rest part including a thigh rest disposed under the body part so as to support the body part and seated on the thigh of a player when playing, an arm rest disposed over the body part such that the arm of a player is placed thereon during playing, and a connection portion interconnecting the thigh rest and the arm rest and having a connection recess upwardly opened and tapered such that the thigh rest and the arm rest and the body part are coupled to each other through insertion of the body part.

3 Claims, 6 Drawing Sheets

DETACHABLE GUITAR

TECHNICAL FIELD

The present invention disclosed herein relates to a detachable guitar, and more particularly, to a detachable guitar in which an arm rest and a thigh rest are detachable from a body thereof.

BACKGROUND

A guitar includes a neck coupled to one side of a body (sound box) and strings arranged onto the neck from the body.

By the way, torsional and bending deflections may occur on the neck of the guitar due to string pulling, humidity, temperature change, etc. This is because the guitar is formed of wood, and the neck and the body are subjected to tension due to continuous pulling of the strings after separately manufactured and then assembled together.

In order to overcome this limitation, the other body and the neck is configured into a folding type to prevent the deformation of the neck by overlapping the neck on the body during storage, and to laterally reduce the total length of the guitar stretched during carrying. However, the neck is not completely separated from the body, and a joint is provided between the neck and the body.

In the case of such guitars, the structure is complicated and a gap between parts occurs, which causes not only a change in the melody during playing, but also the folding structure protrudes outwardly, and the outward appearance is not good. Also, since the strings are entangled when the guitar is folded, the strings need to be disentangled when the guitar is unfolded for performance, thereby making practical use difficult.

Also, since the neck and the body of the guitar are integrally manufactured and thus there is a limitation in reducing the volume, carrying and storage of the guitar are not easy. In addition, the replacement of the body with respect to the neck is impossible, and the repair cost of the guitar due to damage of the neck or body may be increased.

SUMMARY

The present invention provides a detachable guitar in which a body part and a rest part thereof is separable, making it easy to carry and store the guitar and to replace the rest part of the guitar according to a player and thus enabling stable performance and expression of various personalities, and practicing and playing without worrying about noise between floors by enabling connection with earphones.

Embodiments of the present invention provide detachable guitars including: a body part including a head provided with a plurality of tuning pegs and a neck gradually extending in width toward an end portion thereof along a longitudinal direction of the head and having a plurality of strings, one end portion of which is wound around the tuning peg on an upper surface thereof; and a rest part including a thigh rest disposed under the body part so as to support the body part and seated on the thigh of a player when playing, an arm rest disposed over the body part such that the arm of a player is placed thereon during playing, and a connection portion interconnecting the thigh rest and the arm rest and having a connection recess upwardly opened and tapered such that the thigh rest and the arm rest and the body part are coupled to each other through insertion of the body part, wherein: the thigh rest and the arm rest are separable from each other; the body part, the thigh rest and the arm rest are coupled to the core; The outside of the core is formed in a shape corresponding to the outer surface of the connection recess, and the inside thereof is formed to engage with the outer surface of the body part; a bolt is used to couple the core, the thigh rest and the arm rest; the bolt is installed detachably to the core; guides protrude from both sides of the body part; recess grooves are formed in both inner surfaces of the core so as to allow the guide of the body part to be inserted therein; and the guide of the body part is slidingly coupled along the recessed groove of the core.

In some embodiments, the side surface of the body part may have the same inclination as the inner surface of the connection recess making contact with the side of the body part.

In other embodiments, the detachable guitar may include a locking part formed at a position where the body part and the rest part make contact with each other to lock the coupling of the body part and the rest part.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

DETAILED DESCRIPTION OF PREFERRED EMBODIMENTS

Preferred embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art.

Hereinafter, it will be described about an exemplary embodiment of the present invention in conjunction with the accompanying drawings.

Figure 1:
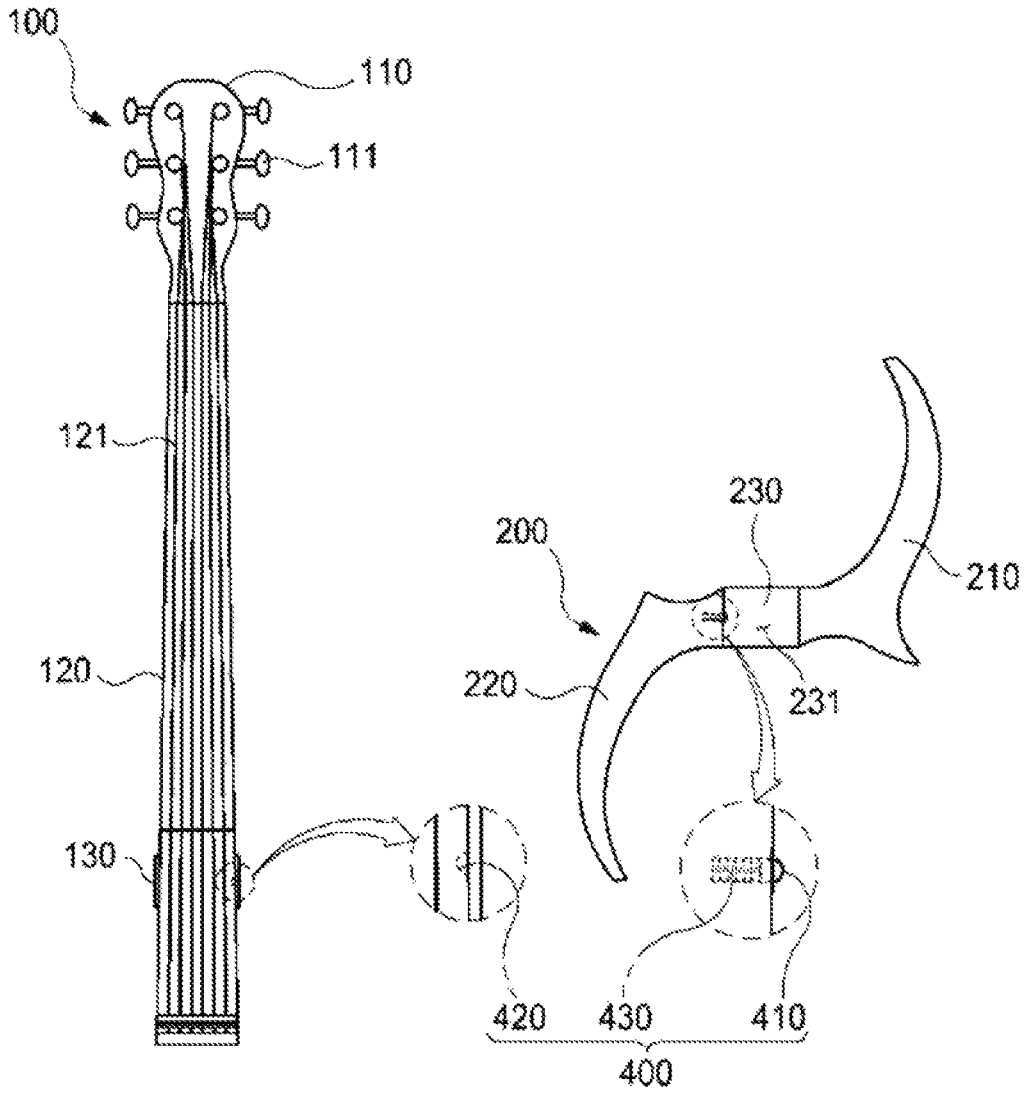
FIG. 1 is a plan view illustrating structures of a body part (left) and a rest part (right) of a detachable guitar according to an embodiment of the present invention.
Figure 2:
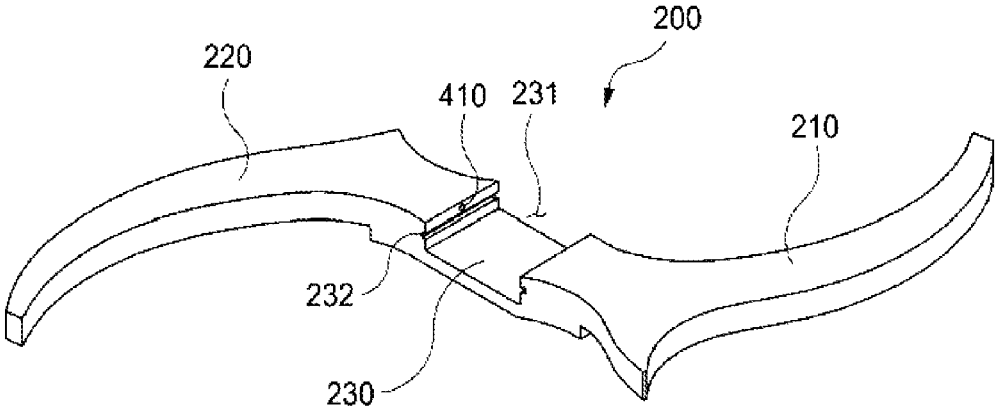
FIG. 2 is a perspective view illustrating a structure of a rest part of a detachable guitar according to an embodiment of the present invention.
Figure 3:
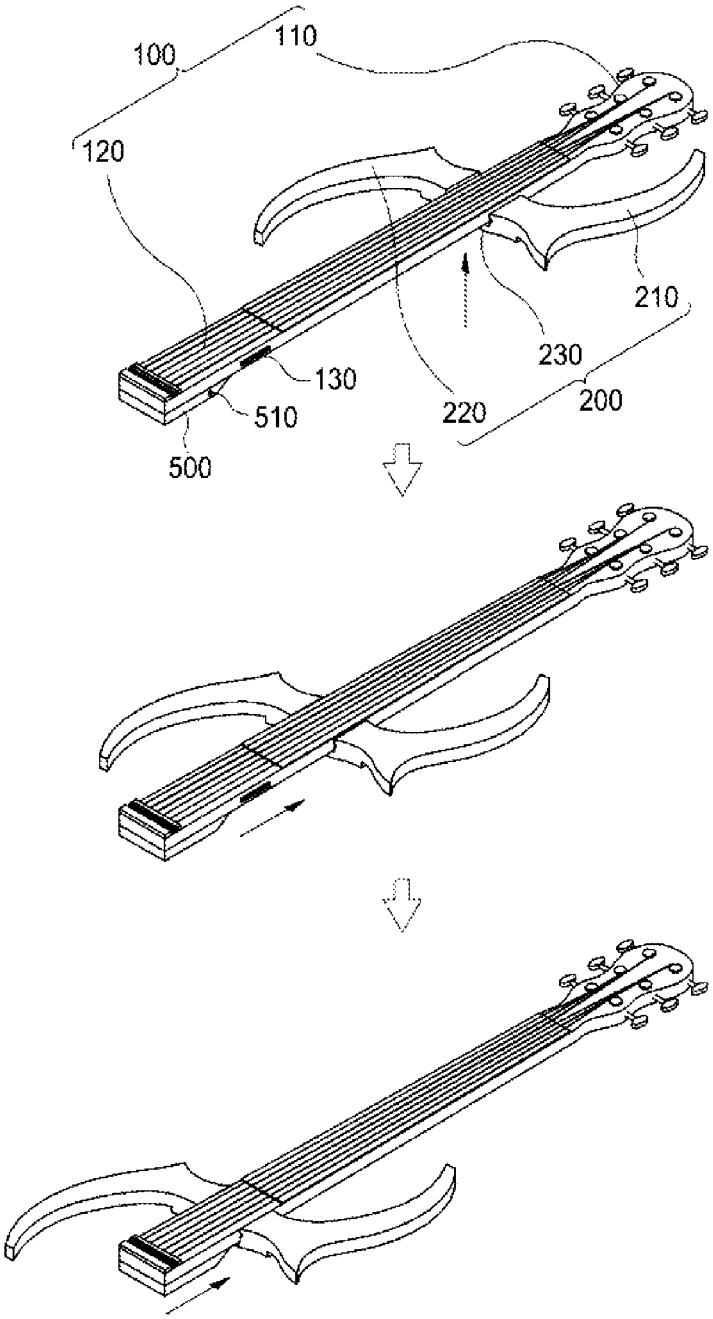
FIG. 3 is a perspective view sequentially illustrating a process of coupling a body part and a rest part of a detachable guitar according to an embodiment of the present invention.
Figure 4:
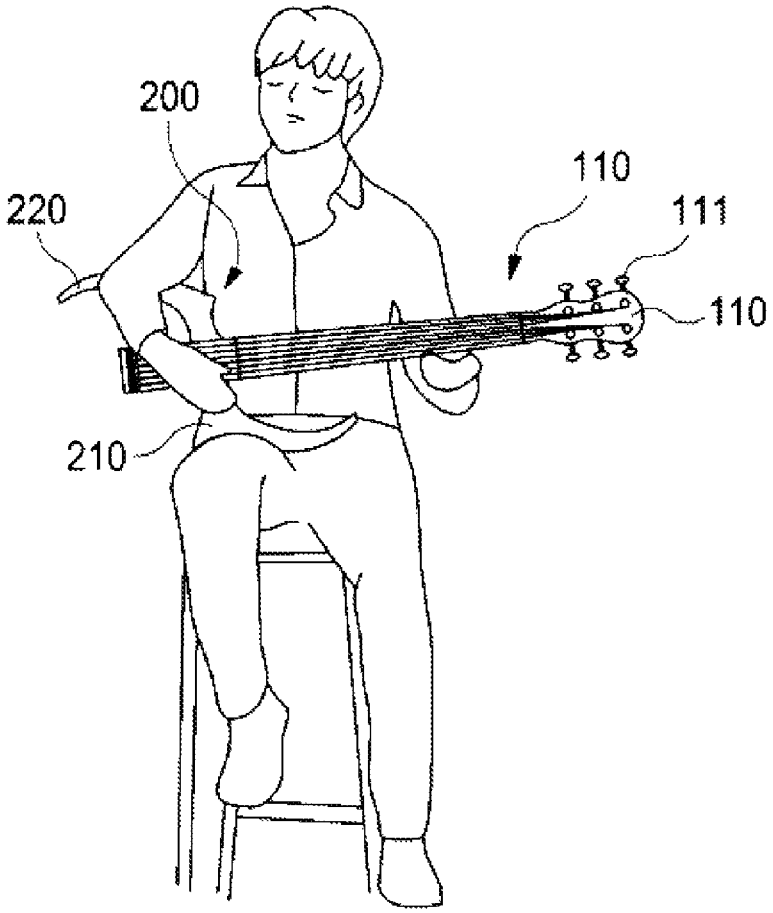
FIG. 4 is a perspective view illustrating a user playing a detachable guitar according to an embodiment of the present invention.
Figure 5A:
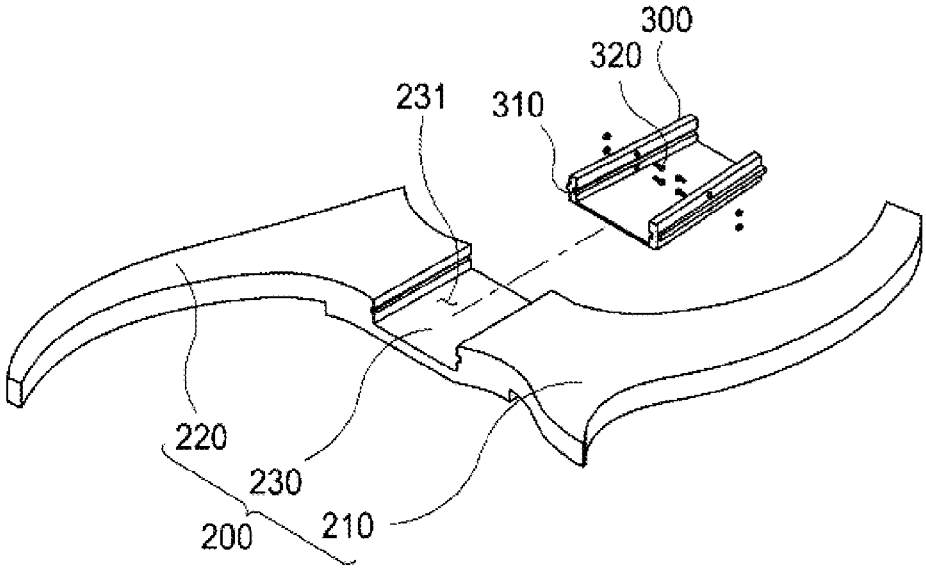
FIGS. 5A and 5B are perspective views illustrating a separated structure of a rest part and a core of a detachable guitar according to another embodiment of the present invention.
Figure 5B:
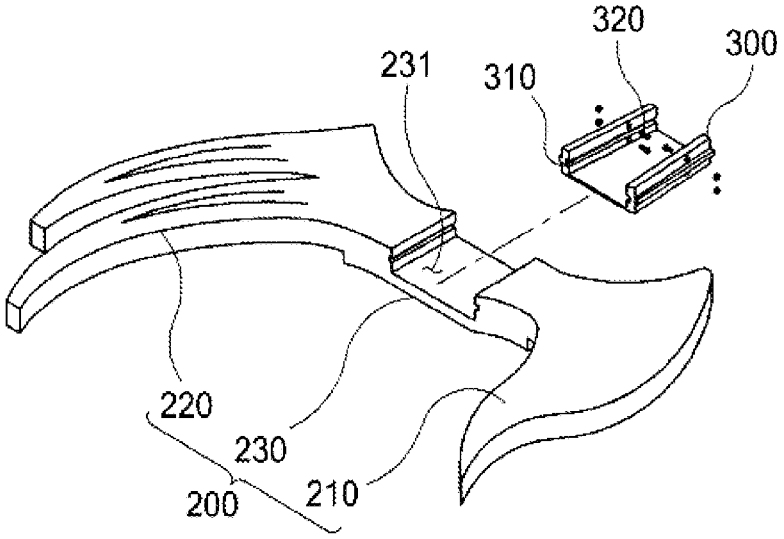

FIG. 1 is a plan view illustrating structures of a body part (left) and a rest part (right) of a detachable guitar according to an embodiment of the present invention. FIG. 2 is a perspective view illustrating a structure of a rest part of a detachable guitar according to an embodiment of the present invention. FIG. 3 is a perspective view sequentially illustrating a process of coupling a body part and a rest part of a detachable guitar according to an embodiment of the present invention, and FIG. 4 is a perspective view illustrating a user playing a detachable guitar according to an embodiment of the present invention. FIGS. 5A and 5B are perspective views illustrating a separated structure of a rest part and a core of a detachable guitar according to another embodiment of the present invention.

Hereafter, exemplary embodiments will be described in detail with reference to the accompanying drawings.

As shown in the drawings, a detachable guitar according to an embodiment of the present invention includes a body part 100 including a head 110 provided with a plurality of tuning pegs 111 and a neck 120 gradually extending in width toward an end portion thereof along a longitudinal direction of the head 110 and having a plurality of strings 121, one end portion of which is wound around the tuning peg 111 on an upper surface thereof, and a rest part 200 including a thigh rest 210 disposed under the body part 100 so as to support the body part 100 and seated on the thigh of a player when playing, an arm rest 220 disposed over the body part 100 such that the arm of a player is placed thereon during playing, and a connection portion interconnecting the thigh rest 210 and the arm rest 220 and having a connection recess 231 upwardly opened and tapered such that the thigh rest 210 and the arm rest 220 and the body part 100 are coupled to each other through insertion of the body part 100.

The body part 100 has a plurality of strings 121 installed on the upper surface thereof, and serves to substantially perform the performance. The body part 100 includes a head 110 which one end portion of the string 121 is wound around and fixed to, and a neck 120 which the other end portion of the string 121 is fixed to and supported by.

A plurality of tuning pegs 111 are rotatably disposed on the head 110 to adjust the tension of the string 121 wound on the outer surface thereof such that tuning is possible. The neck 120 extends from one end of the head 110 so as to have a predetermined length along the longitudinal direction of the head 110, and is formed to gradually increase in width toward the end portion. Thus, when the rest part 200 is coupled to the neck 120, the rest part 200 and the neck 120 can be tightly engaged with each other, allowing the rest part 200 and the body part 100 to be firmly coupled to each other.

Also, when the rest part 200 is coupled to the outer surface of the neck 120, guides 130 are protrusively formed on both side surfaces of the neck 120 contacting the connection portion 230 formed on the rest part 200. Thus, when the rest part 200 is coupled to the outer surface of the neck 120, the guide 130 may guide the coupling position.

The guide 130 is inserted into the recessed groove 232 formed in the connection portion 230 in a sliding manner, allowing the body part 100 and the rest part 200 to be coupled to each other. However, the guide 130 is designed to have such a thickness that the guide 130 is not tightly engaged with the recessed groove 232 such that the rest part 200 is easily detachable from the body part 100.

In order for the body part 100 and the rest part 200 to firmly engage with each other, the width of the neck 120 of the body part 100 gradually increases toward the end portion of the neck 120, and a connection recess 231 formed on the connection portion 230 of the rest part 200 is formed into a tapered shape, thereby enabling firm coupling.

However, the guide 130 is disposed on both side surfaces of the body part 100 formed in the same width as the width of the connection recess 231, allowing the guide 130 to be firmly engaged with the recessed groove 232 along the protruding direction of the guide 130 when the body part 100 and the rest part 200 is coupled to each other.

The side surface of the body part 100 may be formed to have an inclination such that the width becomes narrower toward the upper side along the thickness direction. This is to prevent the body part 100 from being separated from the rest part 200 along the thickness direction when the body part 100 and the rest part 200 are coupled to each other.

On the other hand, the rest part 200 includes the thigh rest 210 provided at a lower side of the body part 100 and seated on the thigh of a player, the arm rest 220 provided at an upper side of the body part 100 such that the arm of a player is placed thereon during the performance, and the connection portion 230 connecting the thigh rest 210 and the arm rest 220 to each other and having the connection recess 231 upwardly opened and tapered such that the thigh rest 210 and the arm rest 220 and the body part 100 can be coupled to each other by receiving the body part 100.

The thigh rest 210 is a member that serves to support the body part 100 such that the body part 100 can be supported at a certain height from the thigh of a player when the player plays the guitar. For this, the thigh rest 210 is disposed under the body part 100 based on the body part 100. Also, the undersurface of the thigh rest 210 may be formed to be curved along the thigh such that a player does not feel discomfort when the thigh rest 210 is seated on the thigh of the player.

The arm rest 220 is disposed at the upper side of the body part 100 which is opposite to the thigh rest 210 based on the body part 100, allowing the arm of a player to be placed thereon. Thus, a player can play the guitar in a comfortable posture. To this end, the upper surface of the arm rest 220 making contact with the player's arm may be formed to be curved. The connection portion 230 serves to allow the thigh rest 210 and the arm rest 220 to be connected to each other, and at the same time, serves to allow the thigh rest 210 and the arm rest 220 to be coupled to the body part 100. To this end, the upper portion of the connection portion 230 is opened, and the connection recess 231 is recessed.

The side surface of the connection recess 231 may be formed to have the same inclination as the body part 100 such that the width is slightly narrowed toward the upper side along the thickness direction. This is to prevent the body part 100 from being separated from the rest part 200 along the thickness direction when the body part 100 and the rest part 200 are coupled to each other.

Also, the connection recess 231 may be tapered such that the width thereof gradually narrows from one side to the other side. This is to prevent a gap between parts by tightly engaging both inner surfaces of the connection recess 231 with the side surfaces of the body part 100 gradually increasing in width toward the end portion when the body part 100 is coupled to the rest part 200.

Also, the recessed grooves 232 into which the guides 130 provided in the body part 100 are inserted may be formed in both inner surfaces of the connection recess 231, thereby guiding the coupling position of the rest part 200 when the body part 100 and the rest part 200 are coupled to each other.

On the other hand, a core 300 may be provided on the connection recess 231 of the connection portion 230. The core 300 may be formed into a shape corresponding to the outer surface of the connection recess 231, and may be engaged with the outer surface of the body part 100 when the body part 100 is coupled to the rest part 200. The core may be formed of a metal material.

When the separate core 300 is installed in the connection recess 231, the connection recess 231 may be formed into a slightly larger size than the case where the core 300 is not installed. When the core 300 is installed, recessed grooves 310 may be formed on both inner surfaces of the core 300 such that the guide 130 provided in the body part 100 can be inserted therein.

As shown in FIG. 5, the core 300 is a metal or wood member detachably installed in the connection recess 231 by a separate bolt 320. When the thigh rest 210 or the arm rest 220 is damaged or when another type of the thigh rest 210 or the arm rest 220 is to be coupled to the body part 100 according to the taste of a player, the core 300 may be continuously used by being attached to a new rest part 200 after separating the core 300.

When the thigh rest 210 and the arm rest 220 are provided to be separated from each other, various types of the thigh rest 210 and the arm rest 220 may be combined with the core 300, thereby changing the shape of the detachable guitar according to the taste of a player.

On the other hand, a separate locking part 400 may be disposed at one side of a mutual contact area between the body part 100 and the rest part 200. The locking part 400 may prevent the body part 100 from being separated from the rest part 200 by fixing the body part 100 to the rest part 200.

As shown in FIG. 1, the locking part 400 includes a ball member 410 elastically supported and having one portion thereof protruding from one side surface of the connection recess 231 and the other portion thereof buried in the side surface of the connection recess 231, and a coupling hole 420 formed in one side surface of the neck 120 corresponding to the installed position of the ball member 410 and selectively receiving the ball member 410 therein.

Also, an elastic spring 430 is installed on one side of the ball member 410 to be in contact with the ball member 410 such that the ball member 410 can be elastically supported, and thus the body part 100 and the rest part 200 are coupled to each other. When the ball member 410 is inserted into the inside of the body part 100 and then the coupling of the body part 100 and the rest part 200 is completed, the ball member 410 is coupled to the coupling hole 420 while generating a clicking sound by elasticity of an elastic spring 430.

The outer surface of the ball member 410 may be formed to have a spherical shape. Accordingly, when the body part 100 is pulled from the rest part 200 by a force of a certain size or more, the ball member 410 is inserted into the rest part 200, and is withdrawn from the coupling hole 420 such that the body part 100 and the rest part 200 can be naturally separated.

The ball member 410 of the locking part 400 may be disposed at a position where the ball member 410 can be inserted into the coupling hole 420 when the rest part 200 is completely coupled to the core 300, thereby preventing a movement between the core 300 and the rest part 200.

The locking unit 400 is not limited to the configuration including the ball member 410, the coupling hole 420 and the elastic spring 430, but may include a button or hook manner. When a button or a hook is pushed, the restraint of the body part 100 may be released to separate the body part 100 and the rest part 200.

Also, a circuit portion 500 having a jack connection hole 510 is provided on the rear surface of the end portion of the body part 100. An electrical signal generated by the string 121 during the performance may be transmitted to an earphone or amplifier to be outputted.

The circuit part 500 may be disposed on the rear surface of the end portion of the body part 100 to improve the structural stability of the detachable guitar and to improve the ease of use by being close to the thigh during the performance.

Also, the circuit part 500 may be embedded in the end portion of the body part 100 to effectively protect from external shock.

Hereinafter, a process of coupling the body part and the rest part of the detachable guitar according to an embodiment of the present invention will be described with reference to FIG. 3.

First, the body part 100 is disposed to intersect with the rest part 200 such that the neck 120 of the body part 100 formed narrower in width than the connection recess 231 formed in the connection portion 230 of the rest part 200 is seated on the upper side of the connection recess 231.

In this state, when the end portion of the body part 100 that is relatively extended in width is pushed to the connection recess 231, the guides 130 protrusively provided on both sides of the body part 100 are inserted into the recessed grooves 232 formed in the connection recess 231, and the body part 100 and the rest part 200 are coupled to each other.

Thereafter, when the end portion of the body part 100 is further pushed toward the connection recess 231, the ball member 410 provided on the inner surface of the connection recess 231 is introduced into the inner surface of the connection recess 231, and the elastic spring 430 is pressed. When the body part 100 is further pushed by a predetermined distance, the ball member 410 is returned to the outside of the connection recess 231, and is inserted into the coupling hole 420, thereby maintaining the firm coupling of the body part 100 and the rest part 200.

In this case, as shown in FIG. 4, a player can play the detachable guitar in a comfortable state in which the thigh rest 210 is seated on the thigh and the arm is placed on the upper surface of the arm rest 220.

The process of separating the body part 100 and the rest part 200 is performed in the reverse order of the above described coupling process, and a detailed description thereof will be omitted.

The detachable guitar according to an embodiment of the present invention having such a configuration is capable of separating the body part and the rest part, such that the guitar is easily portable and stored, and the rest part can be replaced according to the player to enable stable performance and expression of various personalities and earphones. This allows you to practice and play without worrying about floor noise.

In the detachable guitar according to an embodiment of the present invention, since the body part and the rest part can be separated, the volume can be reduced, and thus the guitar is easy to carry and store.

Also, since the rest part of the detachable guitar is selectively replaced according to the body size of a player, the player can use the guitar while replacing only the body part. Accordingly, it is possible to enable not only stable performance but also to express a variety of personality.

In addition, an earphone can be connected to the detachable guitar, and a player can practice and play freely without worrying about noise between floors. Accordingly, convenience of use can be improved.

The present invention can be applied to the field of the stringed instrument played by the player's finger.

The above-disclosed subject matter is to be considered illustrative and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A detachable guitar comprising:

a body part comprising a head provided with a plurality of tuning pegs and a neck gradually extending in width toward an end portion thereof along a longitudinal direction of the head and having a plurality of strings, one end portion of which is wound around the tuning pegs on an upper surface thereof; and a rest part comprising a thigh rest disposed under the body part so as to support the body part and seated on the thigh of a player when playing, an arm rest disposed over the body part such that the arm of a player is placed thereon during playing, and a connection portion interconnecting the thigh rest and the arm rest and having a connection recess upwardly opened and tapered such that the thigh rest and the arm rest and the body part are coupled to each other through insertion of the body part, wherein:

the thigh rest and the arm rest are separable from each other;

the body part, the thigh rest and the arm rest are coupled to a core;

an outside of the core is formed in a shape corresponding to an outer surface of a connection recess, and an inside thereof is formed to engage with an outer surface of the body part;

a bolt is used to couple the core, the thigh rest, and the arm rest;

the bolt is installed detachably to the core;

guides protrude from both sides of the body part;

recess grooves are formed in inner surfaces of the core so as to allow the guides of the body part to be inserted therein; and the guide of the body part are slidingly coupled along the recessed groove of the core.

2. The detachable guitar of claim 1, wherein a side surface of the body part has a same inclination as an inner surface of the connection recess.

3. The detachable guitar of claim 1, further comprising a locking part formed at a position where the body part and the rest part are coupled to each other, the locking part allowing the body part and the rest part to be firmly coupled to each other.

* * * * *